US006892704B2

(12) United States Patent
Tsuchiya et al.

(10) Patent No.: US 6,892,704 B2
(45) Date of Patent: May 17, 2005

(54) FUEL DELIVERY RAIL ASSEMBLY

(75) Inventors: Hikari Tsuchiya, Gotenba (JP); Yoshiyuki Serizawa, Mishima (JP); Tetsuo Ogata, Shizuoka (JP); Kazuteru Mizuno, Numazu (JP)

(73) Assignee: Usui Kokusai Sangyo Kaisha Ltd., Shizuoka (JP)

( * ) Notice: Subject to any disclaimer, the term of this patent is extended or adjusted under 35 U.S.C. 154(b) by 0 days.

(21) Appl. No.: 10/419,118

(22) Filed: Apr. 21, 2003

(65) Prior Publication Data

US 2004/0016418 A1 Jan. 29, 2004

(30) Foreign Application Priority Data

Apr. 22, 2002 (JP) ..... 2002-119836
Nov. 20, 2002 (JP) ..... 2002-336073

(51) Int. Cl.[7] ..... F02M 55/02
(52) U.S. Cl. ..... 123/456; 123/467; 138/30
(58) Field of Search ..... 123/456, 467–469; 138/30

(56) References Cited

U.S. PATENT DOCUMENTS 4,649,884 A 3/1987 Tuckey
4,660,524 A 4/1987 Bertsch et al.
4,729,360 A * 3/1988 Fehrenbach et al. ..... 123/447
6,354,273 B1 3/2002 Imura et al.
6,371,083 B1 * 4/2002 Rossi et al. ..... 123/456
6,640,783 B2 * 11/2003 Braun et al. ..... 123/467
6,672,286 B2 * 1/2004 Miandoab et al. ..... 123/456
2003/0221672 A1 * 12/2003 Zdroik et al. ..... 123/456
2004/0035399 A1 * 2/2004 Curran et al. ..... 123/456

* cited by examiner

*Primary Examiner*—Thomas Moulis
(74) *Attorney, Agent, or Firm*—Wenderoth, Lind & Ponack L.L.P.

(57) ABSTRACT

A fuel delivery rail assembly for supplying fuel to a plurality of fuel injectors in an engine includes an elongated conduit having a longitudinal fuel passage therein, a fuel inlet pipe, and a plurality of sockets. One wall of the conduit opposite to the socket mounting wall includes a flat or arcuate flexible absorbing surface. A high-frequency noise suppressing component such as a rib, a cavity or a clamp is applied to the one wall opposite to the absorbing surface. Thus, fuel pressure pulsations and shock waves are reduced by bending the absorbing surface, and emission of high-frequency noise is eliminated.

8 Claims, 7 Drawing Sheets

Fig. 3(A)
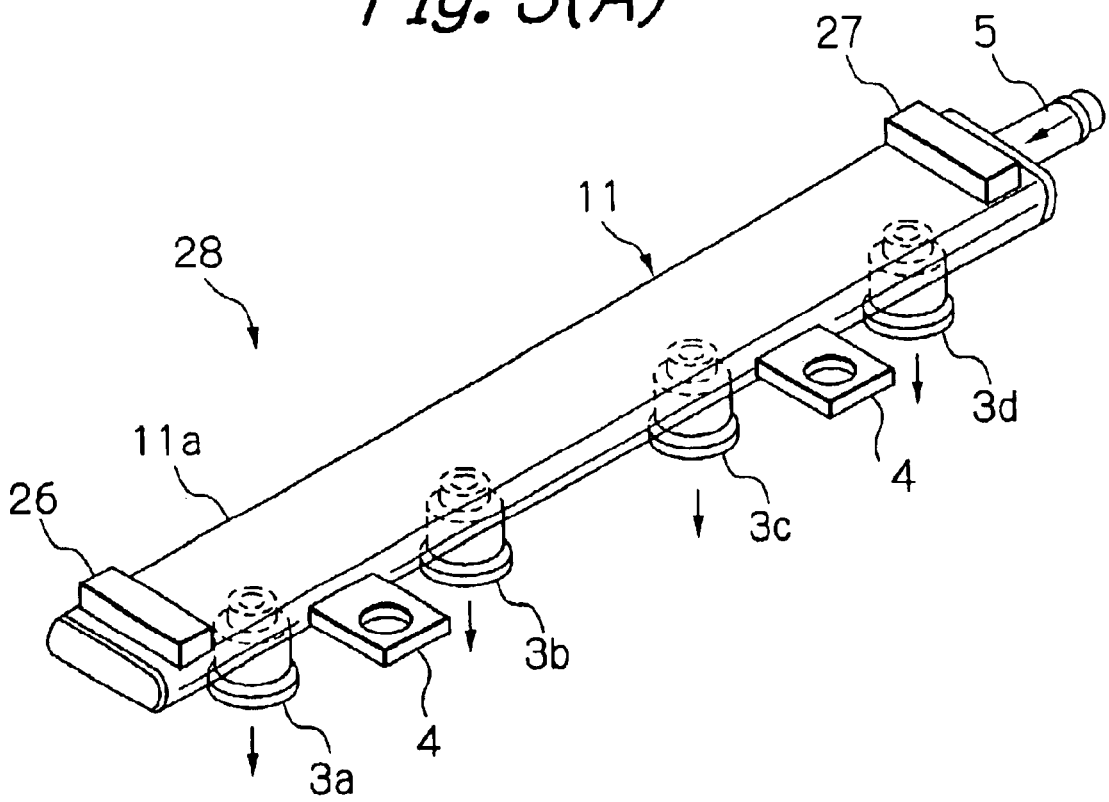
Fig. 3(C)
Fig. 3(B)
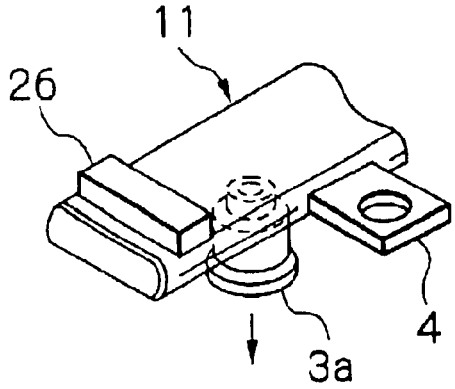
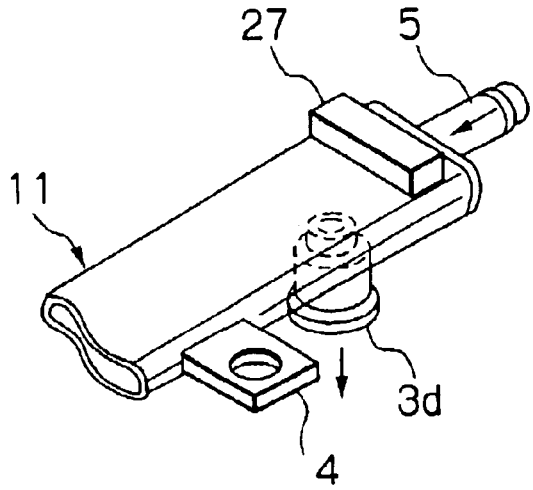

FUEL DELIVERY RAIL ASSEMBLY

BACKGROUND OF THE INVENTION

This invention relates to a fuel delivery rail assembly for an internal combustion engine, especially for an automotive engine, equipped with an electronic fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine. In particular, this invention relates to sectional constructions of a fuel conduit (fuel rail) having a fuel passage therein and connecting constructions between the conduit and sockets for receiving fuel injectors.

Fuel delivery rails are popularly used for electronic fuel injection systems of gasoline engines. There are two types of fuel delivery rails; one is a return type having a return pipe and another is a non-return (returnless) type. In the return type, fuel is delivered from a conduit having a fuel passage therein to fuel injectors via cylindrical sockets and then residual fuel goes back to a fuel tank via the return pipe. Recently, for economical reasons, use of the non-return type is increasing and new problems are arising therefrom. That is, due to pressure pulsations and shock waves which are caused by reciprocal movements of a fuel pump (plunger pump) and injector spools, the fuel delivery rail and its attachments are vibrated thereby emitting uncomfortable noise.

U.S. Pat. No. 6,354,273 (Imura et al.) discloses a fuel delivery rail assembly including at least one flat or arcuate flexible absorbing surface. However, in case that one wall of the conduit opposite to the socket mounting wall is providing the absorbing surface, it tends to emit high-frequency noise, which may be caused by mechanical vibratory resonance.

U.S. Pat. No. 4,660,524 (Bertsch et al.) discloses a fuel supply line having an elastic wall section connected to a rigid wall section.

U.S. Pat. No. 4,649,884 (Tuckey) discloses a fuel rail having a flexible metal membrane which absorbs pulsations created by injectors.

SUMMARY OF THE INVENTION

It is an object of the present invention to provide a fuel delivery rail assembly which can reduce the pressure fluctuations within the fuel passages caused by fuel injections, and also to reduce the vibrations caused by fuel reflecting waves (shock waves), to thereby eliminate emission of uncomfortable high-frequency noise.

A conventional type of fuel delivery rail assembly comprises an elongated conduit having a longitudinal fuel passage therein, a fuel inlet pipe fixed to an end or a side of the conduit, and a plurality of sockets vertically fixed to the conduit adapted to communicate with the fuel passage and formed so as to receive tips of fuel injectors at their open ends.

According to the characteristics of the invention, one wall of the conduit opposite to the socket mounting wall includes a flat or arcuate flexible absorbing surface. In addition, high-frequency noise suppressing means are applied to the outer surface of the conduit as follows:

(A) A high-frequency noise suppressing rib is fixed to the wall having the absorbing surface, across the longitudinal direction of the conduit.

(B) A high-frequency noise suppressing cavity is formed in the wall across the longitudinal direction of the conduit.

(C) A high-frequency noise suppressing clamp is provided for holding the socket mounting wall and the absorbing surface between the clamp.

As a result of the above construction of the invention, in a fuel delivery rail assembly having a fuel conduit made by steel, stainless steel or press materials, it has been found that it becomes possible to eliminate emission of uncomfortable noise including high-frequency noise. These noises are caused by the vibration and pressure pulsations due to the reflecting waves of injections and lack of dampening performance of the conduit.

In a theoretical principle, when shock waves produced by the fuel injections flow into the fuel inlet of the sockets or flow away therefrom by momentary back streams, the flexible absorbing surface absorbs the shock and pressure pulsations. In addition, when thin plates having small spring constant are deflected and deformed, the space of contents varies, namely expands or shrinks, thereby absorbing pressure fluctuations.

Further, the high-frequency noise suppressing means prevents the absorbing surface from vibrating freely and emitting high-frequency noise. Thus, a high-frequency sound component contained in the noise is minimized and diffusion of high-frequency noise is considerably eliminated.

Under the continuous experiments, the following arrangements are found to be most preferable to obtain the best results.

(1) The rib is fixed near one end or each end of the conduit in its longitudinal direction in order to deviate from the maximum bending position of the absorbing surface.
(2) The height of the rib is within a range from one half to four times the thickness of the absorbing surface.
(3) The number of ribs is one to three.
(4) The depth of the cavity is less than half of the total height of the conduit, and the width of the cavity is less than two times of the total height of the conduit.
(5) The clamp is located near one end or each end of the conduit in its longitudinal direction.
(6) The thickness of the absorbing surface is equal to or less than the thickness of other surfaces of the conduit.
(7) The radius of curvature at an edge of the absorbing surface is more than two times the thickness of the absorbing surface.

In this invention, the thickness of each wall of the conduit, ratio of the horizontal size to the vertical size, and the range of clearance between the fuel inlet of the socket and its confronting surface are preferably defined by experiments or calculations such that, especially during idling of the engine, the vibrations and pressure pulsations are minimized.

Since the present invention is directed essentially to the sectional construction of the conduit and connecting construction of the conduit and the sockets, interchangeability with the prior fuel delivery rails are maintained as far as the mounting dimensions are kept constant.

Other features and advantages of the invention will become apparent from descriptions of the embodiments, when taken in conjunction with the drawings, in which, like reference numerals refer to like elements in the several views.

BRIEF DESCRIPTION OF THE DRAWINGS

FIGS. 3A to 3C are perspective views of further modified assemblies.

DESCRIPTION OF THE PREFERRED EMBODIMENT

Figure 1A:
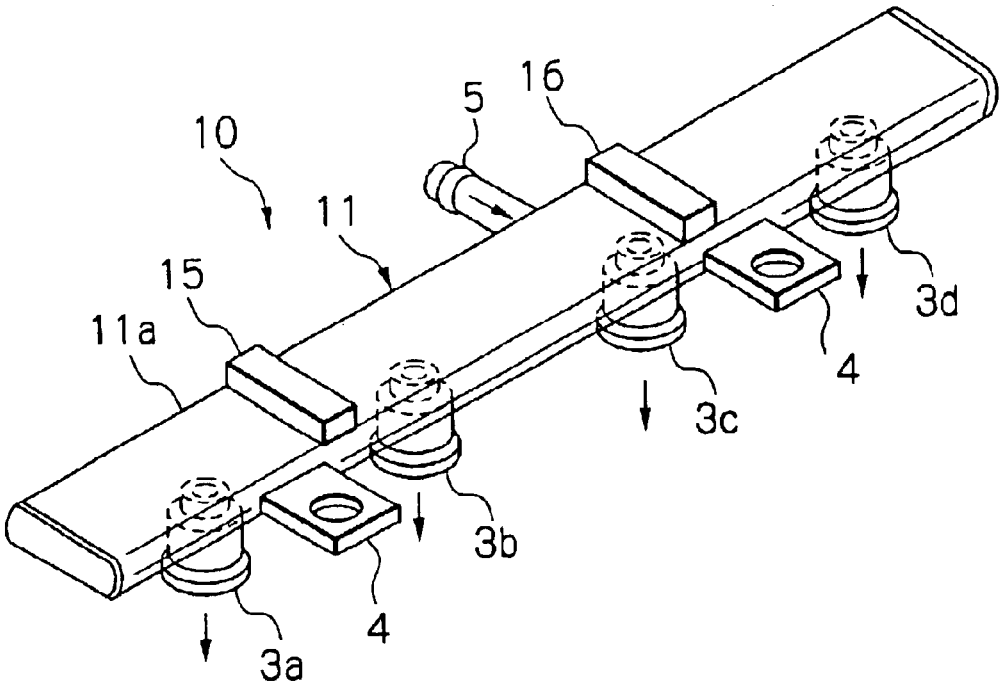
FIG. 1A is a perspective view.
Figure 1B:
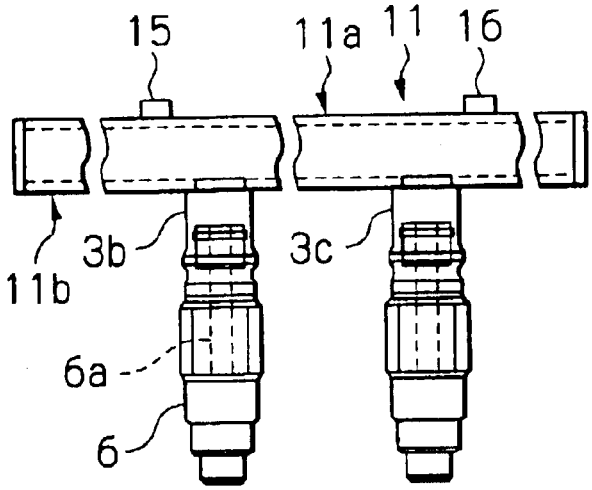
FIG. 1B is a side view and FIG. 1C is a vertical sectional view of a first type of fuel delivery rail assembly according to the invention.
Figure 1C:
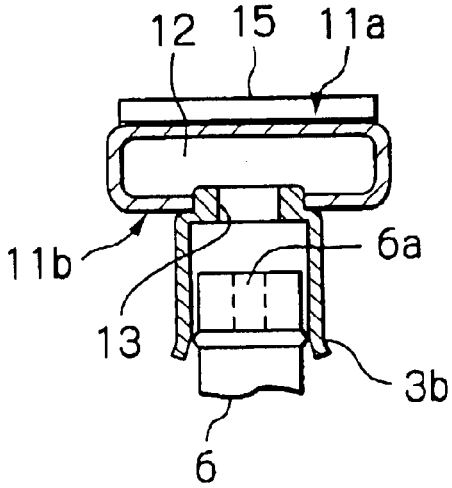

Referring to FIGS. 1A to 1C, there is shown a first type embodiment of the present invention, a fuel delivery rail assembly 10 of the so called "top feed type", adapted to an automotive four-cylinder engine. The fuel conduit (rail) 11 comprised of flat steel pipes extends along a longitudinal direction of a crank shaft (not shown) of an engine.

At the bottom side of the conduit 11, four sockets 4 for receiving tips of fuel injectors are located corresponding to the number of cylinders at predetermined angles and distances from each other. To the conduit 11, two thick and rigid brackets 4 are fixed transversely so as to mount the assembly 10 onto the engine body. Fuel flows along the arrows thereby being discharged from the socket 3 and fuel injectors (not shown) into an air intake passage or cylinders of the engine.

At the side of the conduit 11, a fuel inlet pipe 5 is fixed by brazing or welding. Although at an end of the conduit 11 it is possible to provide a fuel return pipe for transferring residual fuel back to a fuel tank, the present invention is directed to a non-return type having fuel pressure pulsation problems, so that the fuel return pipe is not provided.

As shown in FIG. 1C, the conduit 11 has a flat rectangular cross section such that a circular steel pipe or stainless steel pipe is pressed into a flat form. The vertical and horizontal dimensions of the conduit 11 can be defined such that each wall thickness is 1.2 mm, the height is 10.2 mm, and the width is 28 to 34 mm.

Based upon the characteristics of the present invention, one wall 11*a* of the conduit 11 opposite to the socket mounting wall 11*b* provides a flat flexible absorbing surface 11*a*. Since the absorbing surface 11*a* faces the fuel inlet port 13 of the socket 3, it can absorb shock and vibration during fuel injection timing.

In addition, two ribs 15, 16 are fixed to the wall 11*a* by brazing or welding across the longitudinal direction of the conduit 11. The dimensions of each rib 15, 16 can be defined such that its length is about 80 to 90 percent of the width of the conduit 11, and its height is within a range about one half (50 percent) to four times (400 percent) of the thickness of the absorbing surface 11*a*, and its width is within a range about 30 to 40 percent of the total height of the conduit 11.

As it is understood from FIG. 1C, shock waves emitted from a fuel supply port 6*a* of the injection nozzle 6 pass through the fuel inlet port 13 of the socket and run against the absorbing surface 11*a*, thereby being dampened. During this action, the ribs 15, 16 work to minimize a high-frequency sound component from the vibration noise. Thus, diffusion of high-frequency noise is considerably eliminated.

Figure 2:
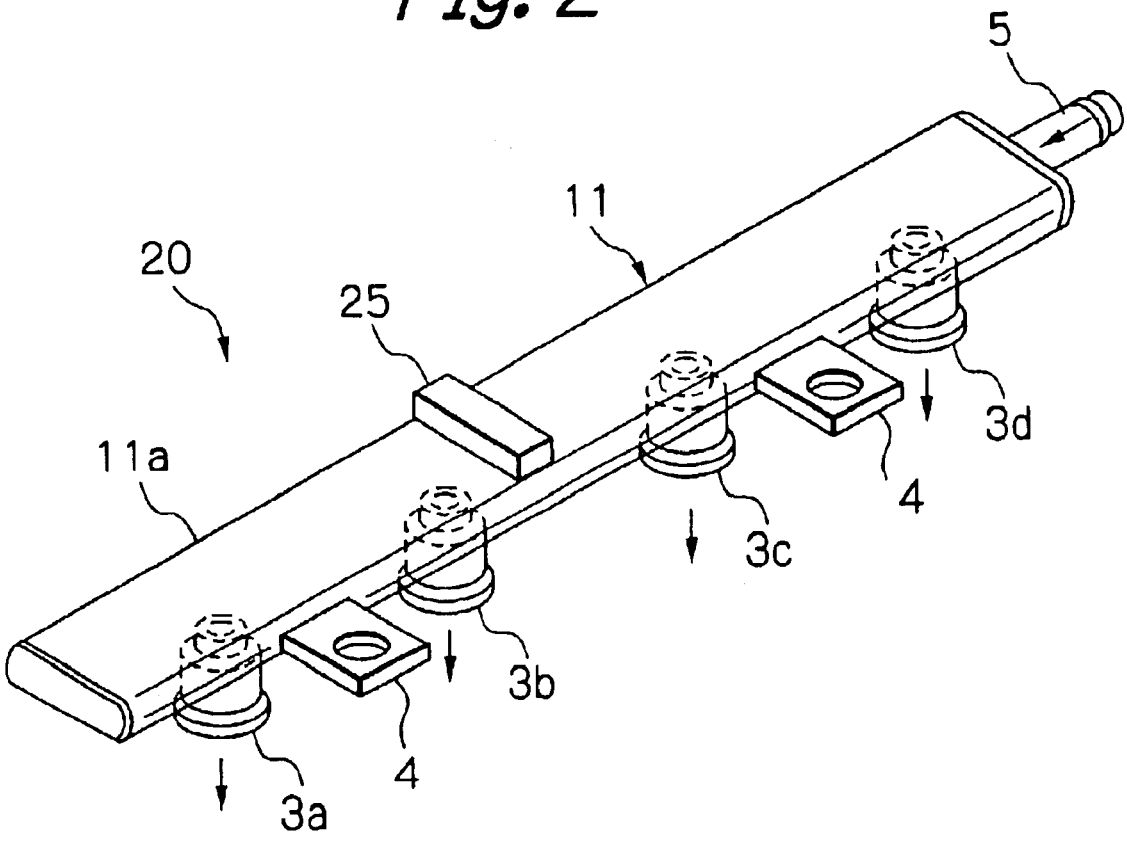
FIG. 2 is a perspective view of a modified assembly.

FIG. 2 illustrates a fuel delivery rail assembly 20 according to a modified embodiment of the invention. In this embodiment, only one rib 25 is located near the midpoint of the conduit 11. Further, the fuel inlet pipe 5 is fixed to a distal end of the conduit 11.

Depending upon a configuration of the fuel rail, the number of ribs can be selected and optimized by continuous experiments.

FIGS. 3A to 3C illustrate further modified embodiments in which one rib or two ribs are located near one end or each end (both ends) of the conduit 11. In FIG. 3A, a rib 26, 27 is located near each end of the conduit 11 (two ribs in total). In FIG. 3B, one rib 26 is located near the free end of the conduit 11. In FIG. 3C, one rib 27 is located near fuel inlet end of the conduit 11. According to some experiments, it has been found that the rib position near the end of the conduit 11 can provide the most effective performance.

Figure 4:
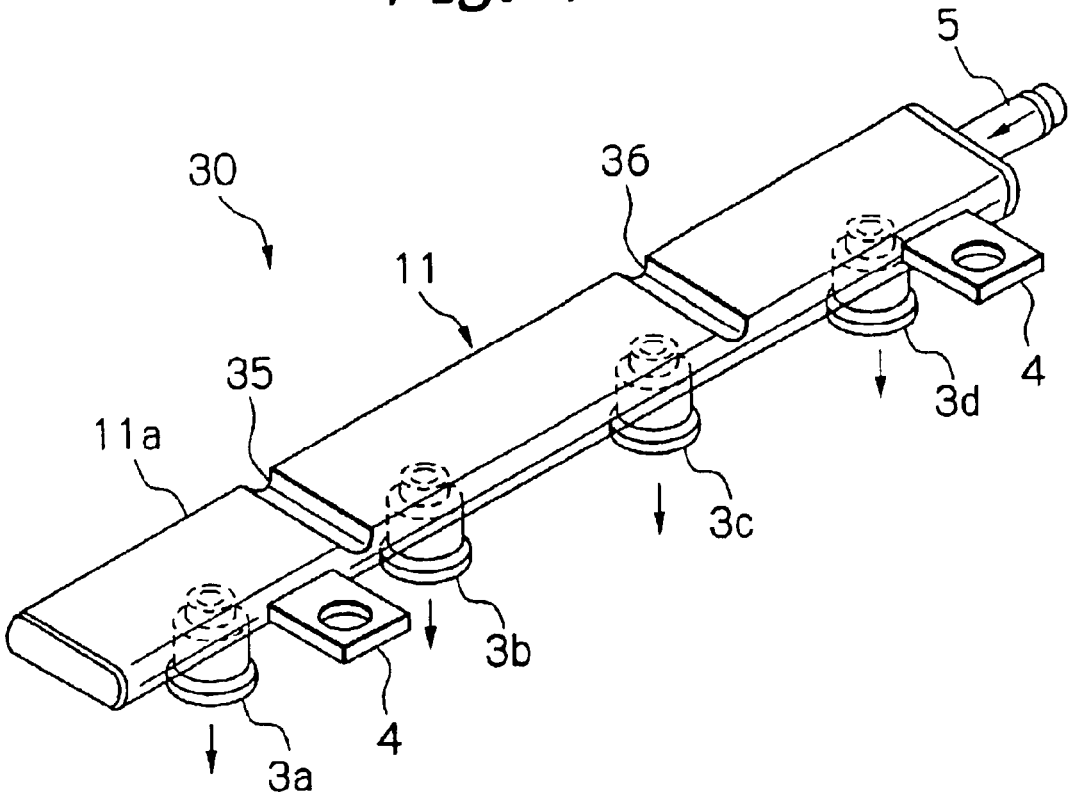
FIG. 4 is a perspective view of a second type of fuel delivery rail assembly.

Referring to FIG. 4, there is shown a second type of embodiment of the present invention, which is a fuel delivery rail assembly 30. Based upon the characteristics of the present invention, one wall 11*a* of the conduit 11 opposite to the socket mounting wall provides a flat flexible absorbing surface 11*a*. Since the absorbing surface 11*a* faces the fuel inlet port of the socket 3, it can absorb shock and vibration during fuel injection timing.

In addition, two cavities 35, 36 are formed in the wall 11*a* across the longitudinal direction of the conduit 11. The dimensions of each cavity 35, 36 can be defined such that its length is about 90 to 100 percent of the width of the conduit 11, and its depth is within a range about 30 to 40 percent of the total height of the conduit 11, and its width is within a range about 100 to 200 percent of the total height of the conduit 11.

The cavities 35, 36 also work to minimize a high-frequency sound component from the vibration noise. Thus, diffusion of high-frequency noise is considerably eliminated.

Figure 5:
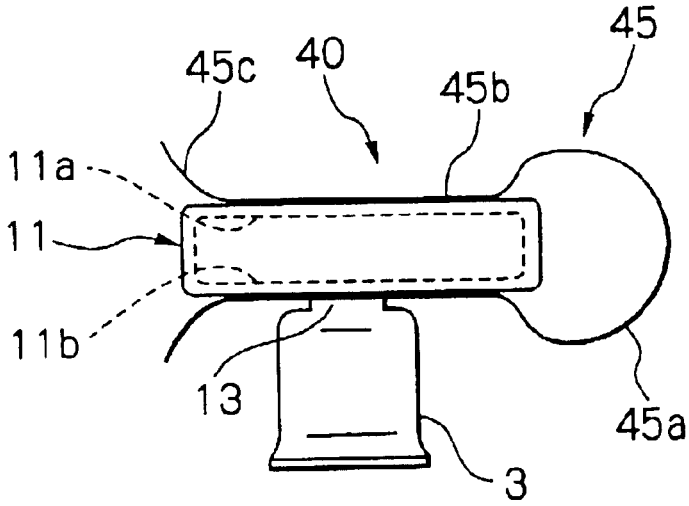
FIG. 5 is a side view of a third type fuel delivery rail assembly.

Referring to FIG. 5, there is shown a third type of embodiment of the present invention, which is a fuel delivery rail assembly 40. Based upon the characteristics of the present invention, one wall 11*a* of the conduit 11 opposite to the socket mounting wall 11*b* provides a flat flexible absorbing surface 11*a*. Since the absorbing surface 11*a* faces the fuel inlet port 13 of the socket 3, it can absorb shock and vibration during fuel injection timing.

In addition, a snap-ring type clamp 45 is located for holding the socket mounting wall 11*b* and the absorbing surface 11*a* between the clamp 45. The clamp 45 comprises a semi-circular head 45*a*, flat retaining portions 45*b* and expanded tails 45*c*.

The clamp 45 also works to minimize a high-frequency sound component from the vibration noise. Thus, diffusion of high-frequency noise is considerably eliminated. The clamp 45 can be made in a removable type as shown in FIG. 5 or made in a rigid type which is fixed to the conduit 11.

Figure 6:
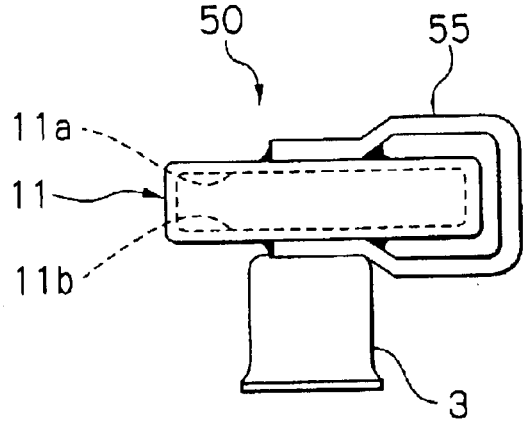
FIG. 6 is a side view of a modified assembly.

Referring to FIG. 6, there is shown a modified embodiment of the present invention, a fuel delivery rail assembly 50. Based upon the characteristics of the present invention, one wall 11*a* of the conduit 11 opposite to the socket mounting wall 11*b* provides a flat flexible absorbing surface 11*a*. Since the absorbing surface 11*a* faces the fuel inlet port of the socket 3, it can absorb shock and vibration during fuel injection timing.

In addition, a rigid U-shape clamp 55 is fixed to the conduit 11 by brazing or welding for holding the socket mounting wall 11*b* and the absorbing surface 11*a* between the clamp 55. The width of the clamp 55 along the longitudinal direction of the conduit 11 can be about 12 mm.

Figure 7A:
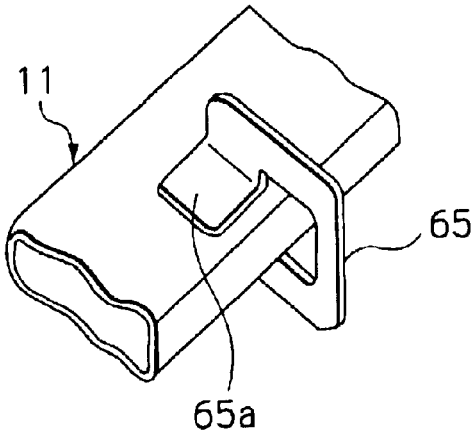
FIG. 7A is a perspective view.
Figure 7B:
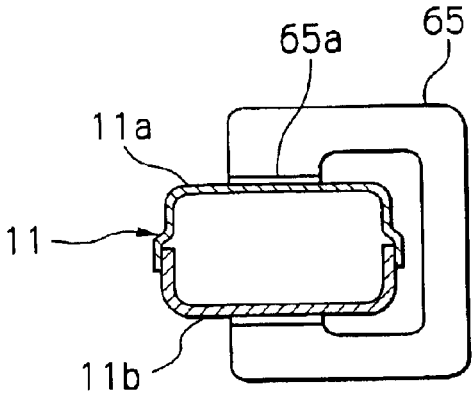
FIG. 7B is a vertical sectional view and FIG. 7C is a side elevational view of a further modified embodiment.
Figure 7C:
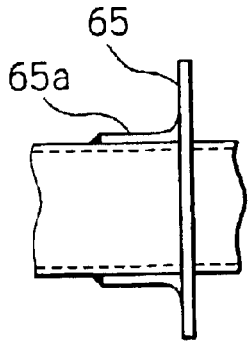

FIGS. 7A to 7C illustrate a further modified embodiment in which a rigid C-shape clamp 65 is fixed to the conduit 11 by brazing or welding for holding the socket mounting wall 11*b* and the absorbing surface 11*a* between the pad portions 65*a* of the clamp 65.

Figure 8A:
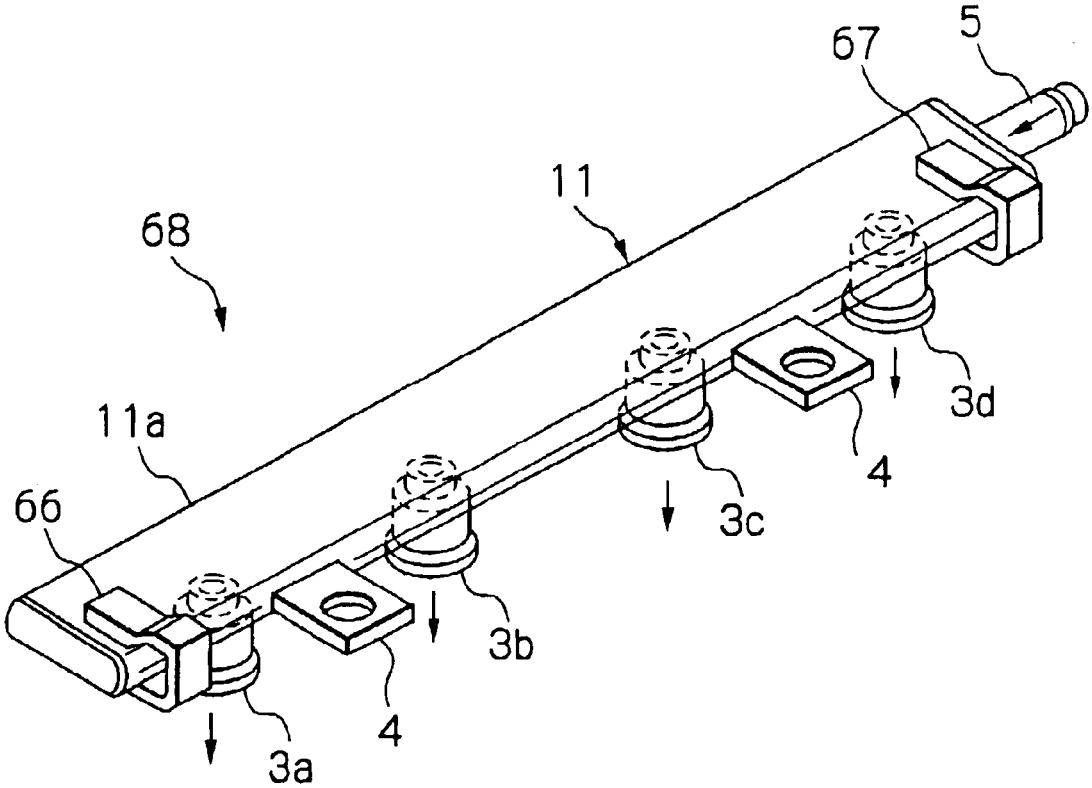
FIGS. 8A to 8C are perspective views of further modified assemblies.
Figure 8B:
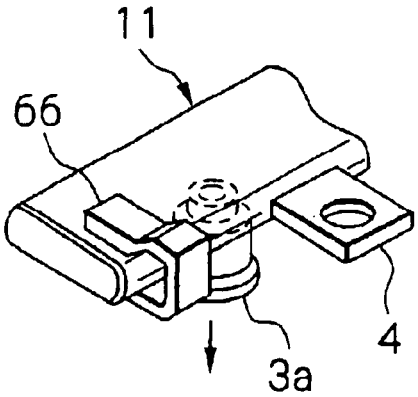
Figure 8C:
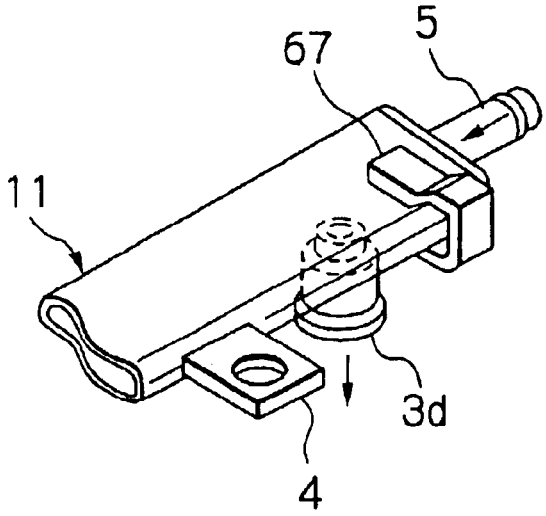

FIGS. 8A to 8C illustrate further modified embodiments in which one clamp or two clamps are located near one end or each end (both ends) of the conduit 11. In FIG. 8A, two clamps 66, 67 are fixed to each end of the conduit 11. In FIG. 8B, one clamp 66 is fixed near the free end of the conduit 11. In FIG. 8C, one clamp 67 is fixed near the fuel inlet end of the conduit 11. According to some experiments, it has been found that the clamp position near the end of the conduit 11 can provide the most effective performance.

Figure 9A:
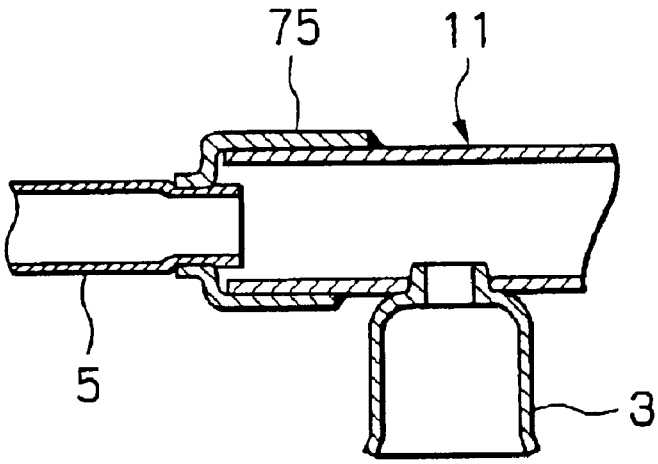
FIGS. 9A and 9B are vertical sectional views of further modified assemblies.
Figure 9B:
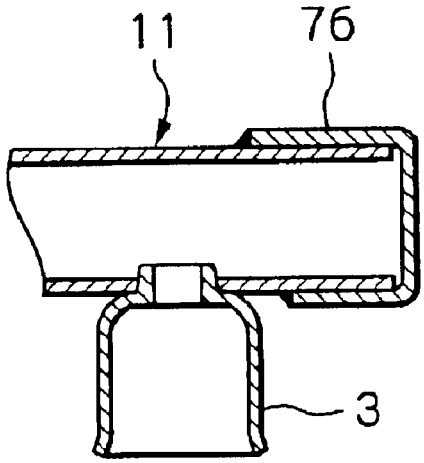

FIGS. 9A and 9B illustrate further modified embodiments in which modified clamps are comprised of end caps 75, 76 each extending along the longitudinal direction and closing an end portion of the conduit 11. These clamps 75, 76 work to prevent the end portions from freely vibrating such that high frequency noise is eliminated. In FIG. 9A, the end cap 75 is connected to the fuel inlet pipe 5 at an end thereof. In FIG. 9B, the end cap 76 is closing the free end of the conduit 11.

As shown in FIGS. 9A and 9B, the end caps 75, 76 are overlapping on the conduit 11. The dimension of the overlapping portion of the end caps 75, 76 can be defined such that its wall thickness is about 50 to 400 percent of the thickness of the absorbing surface 11*a*, and its overlapping length is within a range of about five to twenty times the thickness of the absorbing surface 11*a*.

Several experiments were done for proving the effects of the inventive clamp associated with an actual engine.

(1) Fuel delivery rail: width 34 mm, height 10.2 mm, length 300 mm, wall thickness 1.2 mm, material "Japanese industrial standard STKM11A steel pipe"
(2) Fuel supply pipe from a fuel tank to an engine: outer diameter 8 mm, wall thickness 0.7 mm, material "Japanese industrial standard STKM11A steel pipe"
(3) Engine: six cylinders gasoline engine
(4) measuring points: Variations of acceleration were measured by an acceleration pickup which is located under the floor of an automobile near a connecting portion between a steel fuel supply pipe and a connecting plastic hose which is connected to the fuel inlet pipe 5.

Under the conventional phase in which the inventive clamp is not located, it was found that peak frequency components exist near 600 Hz and 1.3 kHz. Under the inventive phase in which one clamp is located near the midpoint of the longitudinal conduit, it was found that a vibration level (acceleration) was decreased by 55 percent at 600 Hz, and 30 percent at 1.3 kHz. Under the second inventive phase in which two clamps are located near both ends of the longitudinal conduit, it was found that a vibration level was decreased by 70 percent at 600 Hz, and 45 percent at 1.3 kHz.

It should be recognized that various modifications are possible within the scope of the invention claimed.

What is claimed is:

1. A fuel delivery rail assembly for an internal combustion engine comprising:

an elongated conduit having a longitudinal fuel passage therein, a fuel inlet pipe fixed to an end or a side of said conduit, a plurality of sockets vertically fixed to a socket mounting wall of said conduit, said sockets being adapted to communicate with said fuel passage and being formed so as to receive tips of fuel injectors at their open ends, one wall of said conduit opposite to said socket mounting wall including a flat or arcuate flexible absorbing surface, and a rib is fixed to said one wall across the longitudinal direction of said conduit such that high-frequency noise is suppressed by said rib, and fuel pressure pulsations and shock waves are reduced by bending of said absorbing surface.

2. A fuel delivery rail assembly as claimed in claim 1, wherein said rib is fixed near one end of said conduit in its longitudinal direction, or said rib is fixed near said one end of said conduit in its longitudinal direction and a second rib is fixed near a second end opposite said one end of said conduit in its longitudinal direction.

3. A fuel delivery rail assembly as claimed in claim 1, wherein the height of said rib is within a range from one half to four times the thickness of said absorbing surface.

4. A fuel delivery rail assembly for an internal combustion engine comprising:

an elongated conduit having a longitudinal fuel passage therein, a fuel inlet pipe fixed to an end or a side of said conduit, a plurality of sockets vertically fixed to a socket mounting wall of said conduit, said sockets being adapted to communicate with said fuel passage and being formed so as to receive tips of fuel injectors at their open ends, one wall of said conduit opposite to said socket mounting wall including a flat or arcuate flexible absorbing surface, and a cavity formed in said one wall across the longitudinal direction of said conduit such that high-frequency noise is suppressed by said cavity, and fuel pressure pulsations and shock waves are reduced by bending of said absorbing surface.

5. A fuel delivery rail assembly as claimed in claim 4, wherein the depth of said cavity is less than half of the height of said conduit, and the width of said cavity is less than two times of the height of said conduit.

6. A fuel delivery rail assembly for an internal combustion engine, comprising:

an elongate conduit having a longitudinal fuel passage therein, a fuel inlet pipe fixed to an end or a side of said conduit, a plurality of sockets vertically fixed to a socket mounting wall of said conduit, said sockets being adapted to communicate with said fuel passage and being formed so as to receive tips of fuel injectors at their open ends, one wall of said conduit opposite to said socket mounting wall including a flat or arcuate flexible absorbing surface, and a clamp for holding said socket mounting wall and said absorbing surface between portions of said clamp such that high-frequency noise is suppressed by said clamp and fuel pressure pulsations and shock waves are reduced by bending of said absorbing surface.

7. A fuel delivery rail assembly as claimed in claim 6, wherein said clamp is located near one end of said conduit in its longitudinal direction, or said rib islocated near said one end of said conduit in its longitudinal direction and a second rib is located near a second end opposite said one end of said conduit in its longitudinal direction.

8. A fuel delivery rail assembly as claimed in claim 6, wherein said clamp is comprised of an end cap which closes a longitudinal end portion of said conduit.

* * * * *